US012018499B2

(12) United States Patent
Wang et al.

(10) Patent No.: US 12,018,499 B2
(45) Date of Patent: Jun. 25, 2024

(54) SEGMENTAL TRACK-CHANGING AND ACCUMULATIVE SLIDING CONSTRUCTION METHOD FOR UNEQUAL-SPAN STRUCTURE

(71) Applicants: Guangzhou Construction Engineering Co., Ltd., Guangzhou (CN); Guangzhou Wu Yang Construction Machinery Co., Ltd., Guangzhou (CN)

(72) Inventors: Long Wang, Guangzhou (CN); Huqing Liang, Guangzhou (CN); Wei Wei, Shanghai (CN); Wuji Lan, Shanghai (CN); Zhenying Chen, Guangzhou (CN); Jianming Wen, Shanghai (CN); Dehui Lu, Guangzhou (CN); Jiali Cao, Guangzhou (CN); Wenjian Ye, Guangzhou (CN)

(73) Assignees: GUANGZHOU CONSTRUCTION ENGINEERING CO., LTD., Guangzhou (CN); GUANGZHOU WU YANG CONSTRUCTION MACHINERY CO., LTD., Guangzhou (CN)

( * ) Notice: Subject to any disclaimer, the term of this patent is extended or adjusted under 35 U.S.C. 154(b) by 525 days.

(21) Appl. No.: 17/292,144

(22) PCT Filed: Mar. 5, 2020

(86) PCT No.: PCT/CN2020/077990
§ 371 (c)(1),
(2) Date: May 7, 2021

(87) PCT Pub. No.: WO2021/174486
PCT Pub. Date: Sep. 10, 2021

(65) Prior Publication Data
US 2022/0120100 A1 Apr. 21, 2022

(51) Int. Cl.
*E04G 21/16* (2006.01)

(52) U.S. Cl.
CPC ..... *E04G 21/166* (2013.01); *E04G 21/167* (2013.01)

(58) Field of Classification Search
CPC ..... E04G 21/166; E04G 21/167; E04B 2001/2457; E04B 2001/2472;
(Continued)

(56) References Cited

U.S. PATENT DOCUMENTS 5,388,376 A * 2/1995 Demeyer ..... E04C 3/40 52/6
8,745,956 B2 * 6/2014 Wang ..... B66C 13/08 52/741.1
(Continued)

FOREIGN PATENT DOCUMENTS

CN 101139821 A 3/2008
CN 101177956 A 5/2008
(Continued)

OTHER PUBLICATIONS

English translation of the Search Report and Written Opinion for PCT/CN2020/077990 (6 pages). (Year: 2020).*

*Primary Examiner* — Rodney Mintz
(74) *Attorney, Agent, or Firm* — MUNCY, GEISSLER, OLDS & LOWE, PC

(57) ABSTRACT

Provided is an accumulative sliding construction method of segmental track-changing for unequal-span structure, which divides the unequal-span structure into at least two sliding sections according to span variation, and a plurality of track segments corresponding to the spans of each sliding section. By providing sliders on the main truss/beam of each sliding section at positions corresponding to the track segments that each main truss/beam need to pass through, the sliding section smoothly passes through the sliding track segments
(Continued)

to be in position; in addition, the main truss/beam of each sliding section is provided with temporary lengthening auxiliary structure or divided into an initial-mounted unit and rear-mounted units to allow the main truss/beam of each sliding section to pass through the track segments smoothly and to be in place.

9 Claims, 14 Drawing Sheets

(58) Field of Classification Search
CPC ..... E04B 2001/2481; E04B 2001/2484; E04B 1/24; E04B 1/342
See application file for complete search history.

(56) References Cited

U.S. PATENT DOCUMENTS 8,869,336 B2 * 10/2014 Meyer ..... E01D 21/10 414/10
9,278,831 B2 * 3/2016 Gao ..... B66C 13/04
9,441,383 B2 * 9/2016 Wang ..... E04G 21/167
9,670,684 B2 * 6/2017 Wang ..... E04G 21/167
10,435,896 B2 * 10/2019 Wang ..... B66C 23/205
10,683,672 B2 * 6/2020 Wang ..... E04G 21/167
2012/0036811 A1 * 2/2012 Meyer ..... E01D 21/10 52/741.1
2014/0017059 A1 * 1/2014 Wang ..... E04G 21/16 414/815
2014/0346131 A1 * 11/2014 Wang ..... E04G 21/167 212/312
2014/0348623 A1 * 11/2014 Gao ..... B66C 13/04 414/800
2015/0110581 A1 * 4/2015 Wang ..... E04G 21/00 414/800
2016/0194888 A1 * 7/2016 Wang ..... B66C 17/06 212/270
2017/0089082 A1 * 3/2017 Wang ..... E04G 21/00

FOREIGN PATENT DOCUMENTS

CN 101200959 A 6/2008
CN 101725255 A 6/2010
CN 203559597 U 4/2014
CN 106638185 A 5/2017
JP 2010121285 A 6/2010
WO WO-2021174481 A1 * 9/2021 ..... E04G 21/14

* cited by examiner

SEGMENTAL TRACK-CHANGING AND ACCUMULATIVE SLIDING CONSTRUCTION METHOD FOR UNEQUAL-SPAN STRUCTURE

CROSS REFERENCE TO RELATED APPLICATION

This application claims priority to PCT Application No. PCT/CN2020/077990, having a filing date of Mar. 5, 2020, the entire contents of which are hereby incorporated by reference.

FIELD OF TECHNOLOGY

The following relates to a sliding construction method by hydraulic thruster, in particular to a segmental track-changing and accumulative sliding construction method for an unequal-span structure.

BACKGROUND

The mechanization, automation and informatization level of construction is one of the important indicators for building construction technology in a country or region. Compared with the labor-intensive and extensive construction mode of traditional building production, mechanized construction is an effective way to improve engineering quality and reduce labor costs. For example, for construction environment with limited horizontal transportation or limited installation and utilization of hoisting machinery or vertical transportation equipment, accumulative sliding installation technology is often used for steel structure construction, which can greatly improve the construction environment, the construction efficiency, construction quality, and safety, and shorten the construction period with lower engineering cost.

However, the existing accumulative sliding construction methods mostly apply to regular structures. Traditional accumulative sliding construction technology is not applicable for unequal-span structures, as the sliding track couldn't match various intervals of the sliding shoes or the sliders arranged on each sliding main truss and/or beam. Considering above defects, an extensive, labor-intensive and low-tech construction mode, such as a high-altitude spread operation method, is still used for current construction for unequal-span steel structures, which is time-consuming and laborious, and not easy to ensure the construction quality and safety.

The prosperous construction market in China has become the largest one in the world due to the rapid development of social economy and the acceleration of urbanization. With the improvement of material life, people pursue a richer spiritual and cultural life, and have an improved aesthetic taste, thus higher requirements are put forward for the modeling and artistic expression for buildings. A large number of buildings are presented in unequal-span, complex structural forms. Thus, it is urgently required to propose a new mechanized sliding construction technology to change the large-scale, labor-intensive and extensive backward construction production mode in China.

SUMMARY OF INVENTION

An aspect relates to a segmental track-changing and accumulative sliding construction method for an unequal-span structure. The application solves the sliding construction problem of the unequal-span structure with large span alteration.

The present application discloses a segmental track-changing and accumulative sliding construction method for unequal-span structure, which is suitable for unequal-span structure including at least three main trusses and/or beams with different spans, and the construction method comprises the following steps:

Step 1, designing a sliding track: dividing the unequal-span structure into at least two sliding sections and an individual truss and/or beam according to structural span variation, wherein each sliding section comprises a sliding main truss and/or beam and a secondary truss and/or beam connected to the sliding main truss and/or beam;

the sliding track is designed as a plurality of track segments in parallel, wherein both the track segments and the sliding sections have same quantities, each track segment is offset from an adjacent track segment by a certain distance, and the certain distance is respectively corresponding to a span differential between every two adjacent main trusses and/or beams;

Step 2, analyzing a sliding process of the unequal-span structure, a weight of the sliding structure and a track layout, such that a specification, a quantity and a layout of sliding hydraulic thrusters are determined;

Step 3, installing the track segments and an assembly platform: installing the track segments are arranged according to the design of Step 1, and the assembly platform used to assemble the structure is mounted to a first track segment, wherein the first track segment extends onto the assembly platform;

Step 4, starting the sliding process: a first main truss and/or beam assembled on the assembly platform, and an assembled anti-overturning temporary auxiliary device is also arranged for preventing the first main truss and/or beam from overturning during the sliding process, and then the first main truss and/or beam is pushed away from the assembly platform along the sliding track by the hydraulic thrusters;

after the first main truss and/or beam leaving the assembly platform, a second main truss and/or beam is assembled on the assembly platform, and a secondary truss and/or beam is assembled between the sliding main truss and/or beam and the second main truss and/or beam so as to connect the first main truss and/or beam to the second main truss and/or beam together as a whole, then the assembled anti-overturning temporary auxiliary device is detached, thus a first sliding section is completely assembled;

Step 5, sliding in a track-changing process: pushing the first sliding section in Step 4 and the second main truss and/or beam forward by the hydraulic thrusters until the first main truss and/or beam reaches an overlapping position where the first track segment meets a second track segment;

due to track gauge differences of the track segments, each main truss and/or beam is provided with a slider corresponding to the second track segment that the main truss and/or beam will slide on, so that the main truss and/or beam leaves the first track segment and slides on the second track segment by virtue of the slider to achieve the track-changing process.

According to one aspect of the construction method of the present application, when the span of the main truss and/or beam is smaller than the track gauge of the track segments on which the main truss and/or beam will slide, an assembled temporary lengthening auxiliary structure is attached at both ends of main truss and/or beam. Thus the span of the main truss and/or beam is enlarged to the track gauge of the track segments, and the main truss and/or beam can successfully slide on the track segments.

According to an aspect of the construction method of the present application, the assembled temporary lengthening auxiliary structure includes a plurality of sub-units, and the length of each sub-unit corresponds to a track gauge difference of two adjacent track segments of the track segments.

According to an aspect of the construction method of the present application, as the main truss and/or beam passes one of the track segments, the sub-units corresponding to the one of the track segments are removed, thus the main truss and/or beam can slide on the next track segment.

According to an aspect of the construction method of the present application, when the span of the main truss and/or beam is larger than the track gauge of the track segment on which the main truss and/or beam will slide, the main truss and/or beam is divided into an initial sliding unit and rear-mounted units which are installed at both ends of the initial sliding unit, wherein a span of the initial sliding unit is equal to the track gauge of the track segment. Therefore, the initial sliding unit smoothly slides on the first track segments.

According to an aspect of the construction method of the present application, the rear-mounted units comprise a plurality of sub-units, a length of each sub-unit corresponding to a track gauge difference of two adjacent track segments of the plurality of track segments. Thus, when the main truss and/or beam passes one of the track segments and switches to another track segment with different track gauge, the subsequent sub-units are assembled so that the span of the main truss and/or beam is adapted for a slide on the subsequent track segments.

According to an aspect of the construction method of the present application, as the sliding main truss and/or beam passes one of the track segments, the sub-units corresponding to next one of the track segments could be mounted, thus the main truss and/or beam can continue to slide on the subsequent track segments.

According to an aspect of the construction method of the present application, folding hinges are used for mounting the rear-mounted units to the initial sliding unit, as well as connections between the plurality of sub-units of the rear-mounted units. As the sliding main truss and/or beam passes one of the track segments, one of the plurality of sub-units corresponding to the next one of the track segment is unfolded, so that the main truss and/or beam can continue to slide on the subsequent track segments. Thus, all the rear-mounted units can be installed initially, and the corresponding sub-units are unfolded when the track segments are switched.

According to an aspect of the construction method of the present application, the connections between the main truss and/or beam and the assembled temporary lengthening auxiliary structures, the connections between the initial sliding unit and the rear-mounted units, the connections between the plurality of sub-units of the assembled temporary lengthening auxiliary structures, and the connections between the plurality of sub-units of the rear-mounted units are formed by channel steels and high strength bolts, which facilitates the installation.

According to an aspect of the construction method of the present application, in Step 4 of the construction method, before pushing the first main truss and/or beam to slide, the assembled anti-overturning temporary auxiliary device is arranged in front and rear of the first main truss and/or beam.

The assembled anti-overturning temporary auxiliary device is L-shaped or triangular, welded by section steels or steel plates. One end of the assembled anti-overturning temporary auxiliary device is temporarily fixed with the main truss and/or beam through bolts, and the other end of the assembled anti-overturning temporary auxiliary device is arranged on the sliding track segments. Sliders are arranged between the assembled anti-overturning temporary auxiliary device and the sliding track segments to ensure a relatively smooth slide between the two. A first set of hydraulic thrusters is mounted on the main truss and/or beam and propels the main truss and/or beam to a predetermined position.

According to an aspect of the construction method of the present application, to facilitate the sliding out and the sliding in of the sliders, when changing track segments, the track segment is provided with a guiding exit at an end that the slider slides out and a guiding entrance at an end that the slider slides in, so that the sliding structures could smoothly switch between track segments with different track gauges and continue to slide. Further, the overlapping length of a prior track segment and a subsequent track segment is long enough for replacing and installing the hydraulic thrusters on the prior and subsequent track segments.

The segmental track-changing and cumulative sliding construction method for an unequal-span structure of the present application not only solves an engineering problem that the traditional accumulative sliding construction method for unequal-span structures is difficult to be implemented, but also effectively alter the extensive, labor-intensive and low-technology-level construction mode that is still largely adopted in the unequal-span steel structure construction, such as the high-altitude spread operation method, and the like. The construction method of the present invention overcomes the defects of time-consuming, labor-consuming, and difficult to guarantee the construction quality and safety in the construction of the structures. Further, the mechanization and automation of construction is improved, and the construction period and costs are saved.

BRIEF DESCRIPTION OF DRAWINGS

The present disclosure will be described hereinafter in details with reference to the figures and the embodiments, obviously, the figures to be described below are merely embodiments of the present disclosure. For those skilled in the art, other figures may be obtained according to these figures without any creative work.

DETAILED DESCRIPTION OF EMBODIMENTS

In order that the objectives, technical solutions, and advantages of the present disclosure will become more apparent, specific embodiments of the present disclosure will be further described with reference to the accompanying drawings.

Embodiment 1

Embodiment 1 of the present application is shown in FIGS. 1-14.

Figure 1:
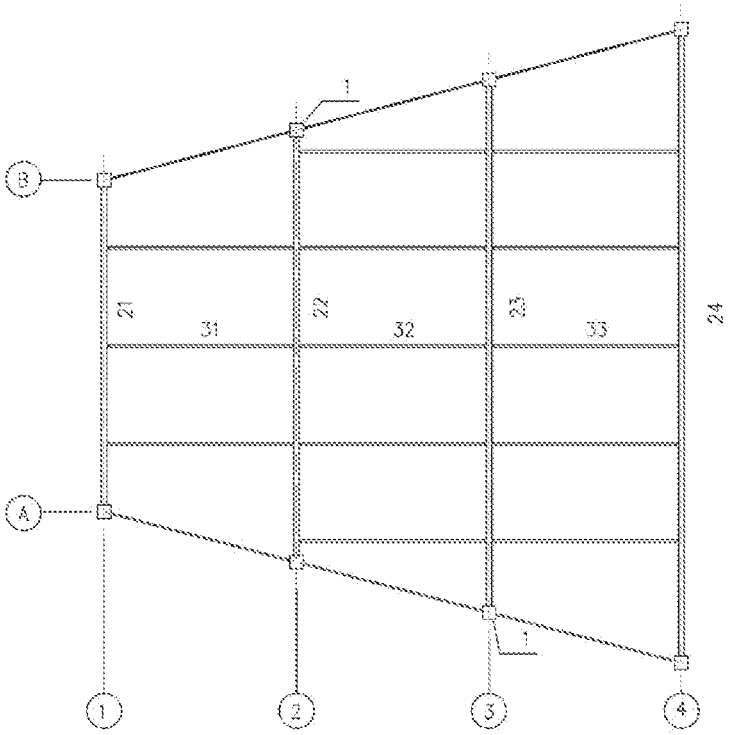
FIG. 1 is a schematic plan view of an unequal-span structure according to the first embodiment of the present disclosure.

FIG. 1 illustrates a typical roof or floor in an unequal-span structure including four main trusses and/or beams 21, 22, 23, 24, with different spans and three sets of secondary trusses and/or beams 31, 32, 33, wherein the four main trusses and/or beams 21, 22, 23, 24 are connected by the three set of secondary trusses and/or beams 31, 32 33 as a whole and supported on structural columns 1.

The sliding construction of the unequal-span structure is carried out by sliding from a side with a larger span to a side of a smaller span, due to restriction of construction site conditions. And the segmental track-changing and accumulative sliding construction method for an unequal-span structure includes the following steps.

Figure 2:
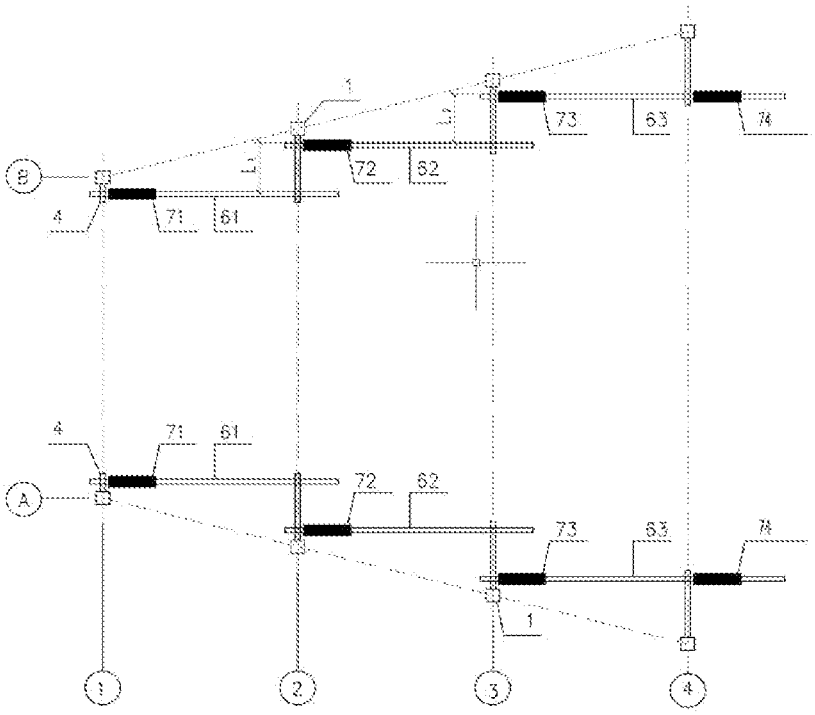
FIG. 2 is a schematic diagram illustrating layout of a sliding track and an equipment system according to the first embodiment of the present disclosure.

(1) The sliding track is designed and arranged. As shown in FIG. 2, considering safety and economic factors, the unequal-span structure is divided into three sliding sections and a fourth truss/beam, which could be installed directly at the end, according to the shape and size of the unequal-span structure and the arrangement, wherein each sliding section includes a main truss and/or beam and a secondary trusses and/or beam connected to the main truss and/or beam.

According to the division of the unequal-span structure, the sliding track is divided into three track segments 61, 62 and 63 in parallel with different track gauges. The track gauge of each track segment corresponds to the span of a sliding section, and the distance that each track segment offsets from its adjacent track segment in the span direction is shown as L1, L2, respectively.

(2) The whole process of accumulative sliding, the weight of the sliding structure and the track layout are analyzed, so that the specification, quantity and layout of the sliding hydraulic thrusters 71, 72, 73 and 74 are determined, as shown in FIG. 2.

Figure 3:
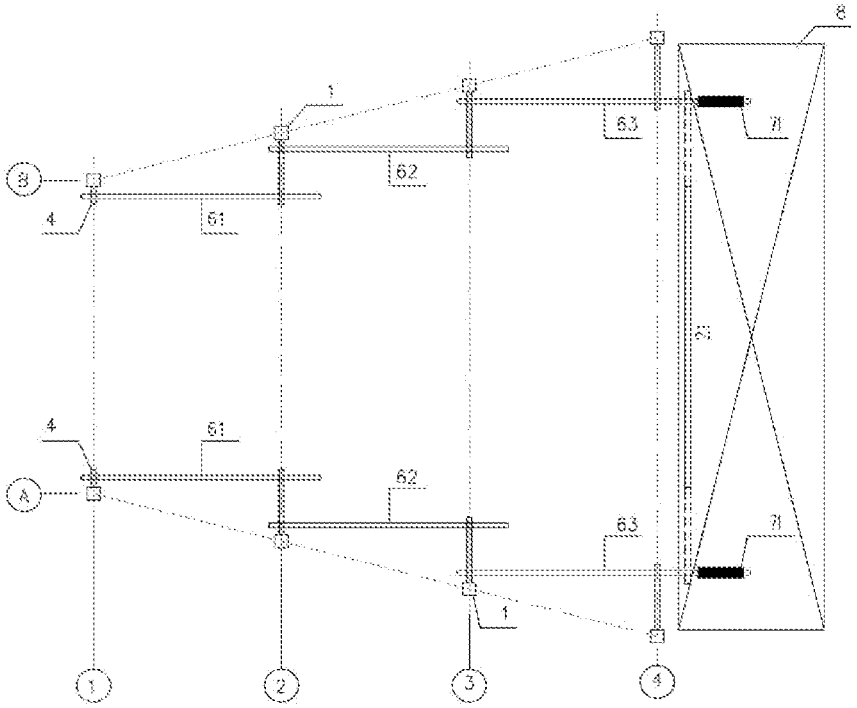
FIG. 3 is a schematic diagram of a main truss and/or beam prepared for assembly according to the first embodiment of the present disclosure.
Figure 11:
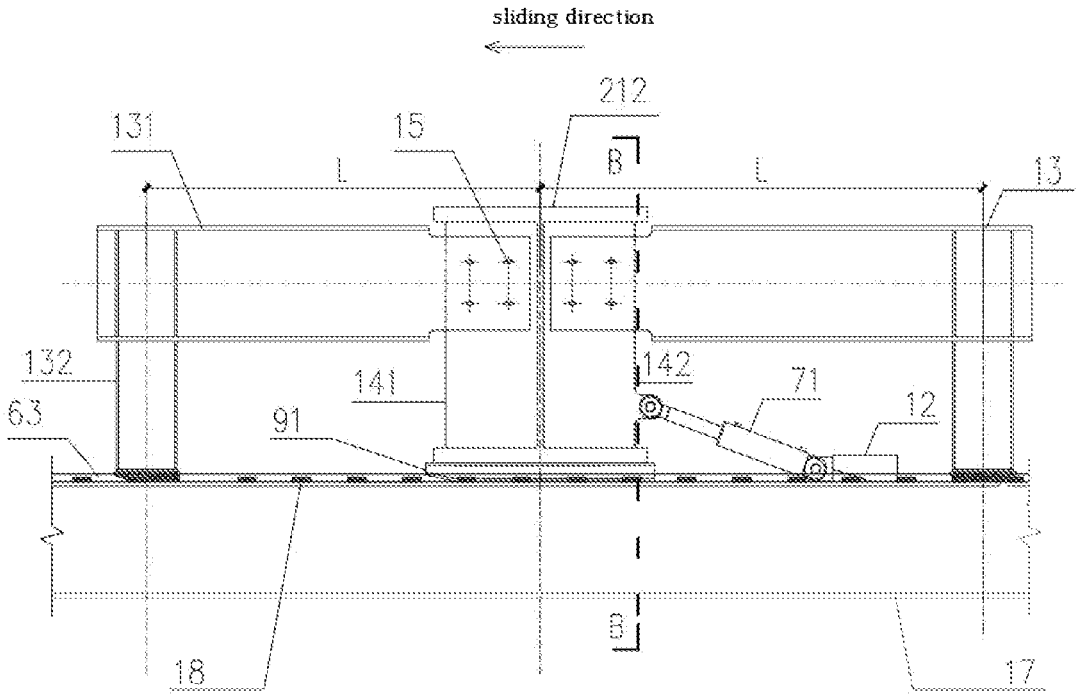
FIG. 11 is a detail drawing of an assembled anti-overturning temporary auxiliary device according to the present disclosure.

(3) The track segments and assembly platform are installed. As shown in FIG. 3 and FIG. 11, the track beam 17, the track beam supporting structure 4 and the track segments 61, 62 and 63 are installed according to the design of step (1). And an assembly platform 8 used to assemble the structure is mounted on the track at the initial sliding end where the track segment has a larger track gauge. In this embodiment, the assembly platform 8 is installed on the track segment 63. Once a main truss and/or beam is assembled, the main truss and/or beam may leave the assembly platform 8 to slide along the track segment, so that the assembly platform 8 could be used for assembling a subsequent main truss and/or beam. Then the secondary truss and/or beam between the two main trusses and/or beams can be installed, thus a sliding section including the prior main truss and/or beam is completely installed. The rest parts could be assembled and mounted in a similar way, so that all sliding sections can be assembled and slide.

The track segment 63 at the initial sliding end may extend onto the assembly platform as desired, as shown in FIG. 3.

(4) The sliding process begins. As shown in FIGS. 3-5 and 8, after being assembled on the assembly platform 8, since the length of the first main truss and/or beam 21 is less than the track gauge of the track segments 63, the first main truss and/or beam 21 is attached with an assembled temporary lengthening auxiliary structure 212 on both ends, so that the first main truss and/or beam 21 can slide on the track segments 63.

The first set of hydraulic thrusters 71 could be installed on the first main truss and/or beam 21 after the installation of the first main truss and/or beam 21 and the assembled temporary lengthening auxiliary structure 212, and then the first set of hydraulic thrusters 71 controlled by a computer control system is employed to push the first main truss and/or beam 21 to travel along the track segments 63.

(5) Track-changing process begins: a track-changing process is required when the sliding structure, for example the first main truss and/or beam 21, is switched between the track segments due to different track gauges of track segments 61-63.

Figure 8:
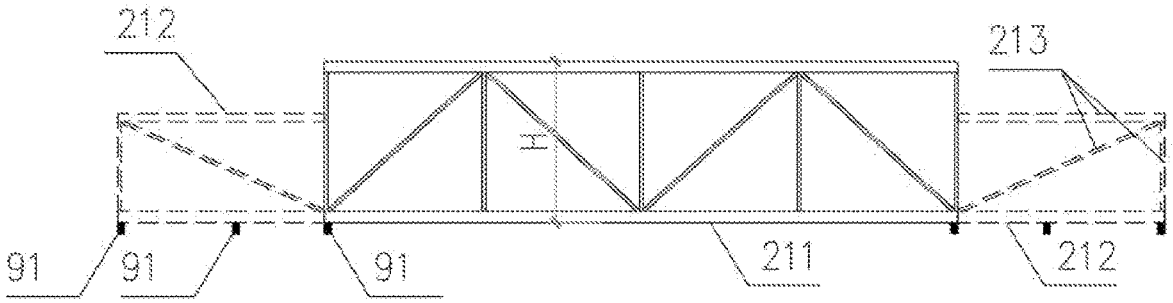
FIG. 8 is a schematic diagram of the sliding main truss and/or beam with an assembled temporary lengthening auxiliary structure according to the first embodiment of the present disclosure.
Figure 9:
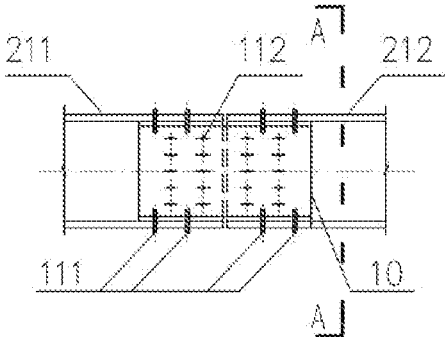
FIG. 9 is a detail drawing illustrating connection of the assembled temporary lengthening auxiliary structure according to the first embodiment of the present disclosure.
Figure 10:
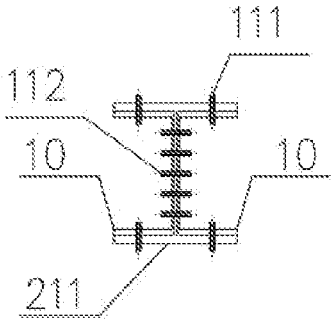
FIG. 10 is a cross sectional view of FIG. 9 along A-A line.

The sliding process of each main truss and/or beam is analyzed, and the track segments on which each main truss and/or beam successively slides are determined. Then sliders 91 could be arranged at corresponding positions of the main truss and/or beam and/or the assembled temporary lengthening auxiliary structure 212, so that the track-changing process can be achieved between the track segments with different track gauges. Taking the first main truss and/or beam 21 as an example, this step is carried out as follows:

1. The first main truss and/or beam 21, which is of the minimum span length, needs to slide on all three track segments 63, 62 and 61 in sequence. As shown in FIG. 8, at least one assembled temporary lengthening auxiliary structure 212 is provided at both ends of the first main truss and/or beam 21 to allow the first main truss and/or beam 21 to slide on the track segments 63, 62, whose track gauge is greater than the span of the first main truss and/or beam 21. The assembled temporary lengthening auxiliary structures 212 are temporarily connected to lower chord 211 of the first main truss and/or beam 21 via channel steels 10 by high-strength bolts 111, 112, as shown in FIGS. 9 and 10, wherein FIG. 10 is a sectional view taken along A-A line in FIG. 9.

The length of the assembled temporary lengthening auxiliary structure 212 is determined by the track gauge differences of the track segments 61, 62 and 63, which is shown as L1+L2 in FIG. 2. For the facilitation of disassembling and assembling in the construction process, the assembled temporary lengthening auxiliary structure 212 includes a plurality of attachable sub-units, according to the track segments on which the main truss and/or beam 21 needs to slide. The sub-units are connected, as shown in FIG. 9 and FIG. 10. The length of each sub-unit is determined by the track gauge differences of the track segments on which the main truss and/or beam 21 will slide, and thus the length of the sub-units is L1 and L2, respectively. Further, in at least one embodiment, chord members and web members 213 may be additionally arranged on the assembled temporary lengthening auxiliary structure 212 as required, and the chord members and web members 213 are connected by high-strength bolts. In addition, sliders 91 are arranged on the first main truss and/or beam 21 and the assembled temporary lengthening auxiliary structure 212 at positions where the lengthened first main truss and/or beam 21 slides on the track segments 61, 62 and 63, as shown in FIG. 8.

Figure 4:
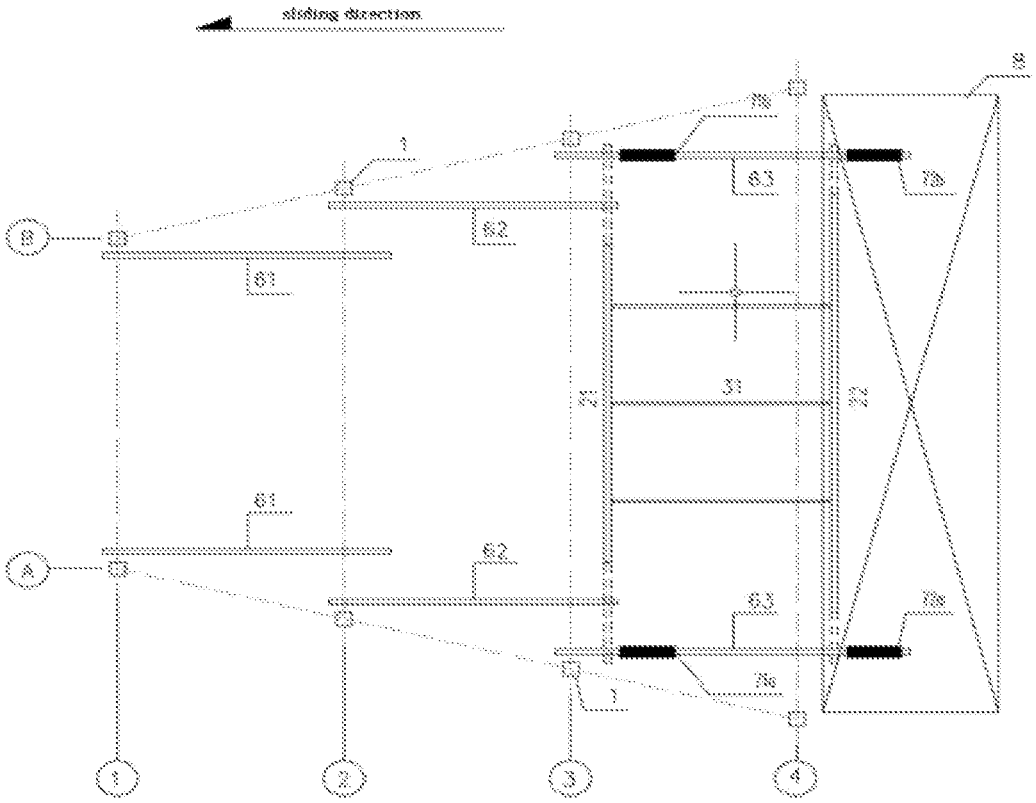
FIG. 4 is a schematic diagram illustrating the track-changing process according to the first embodiment of the present disclosure.
Figure 5:
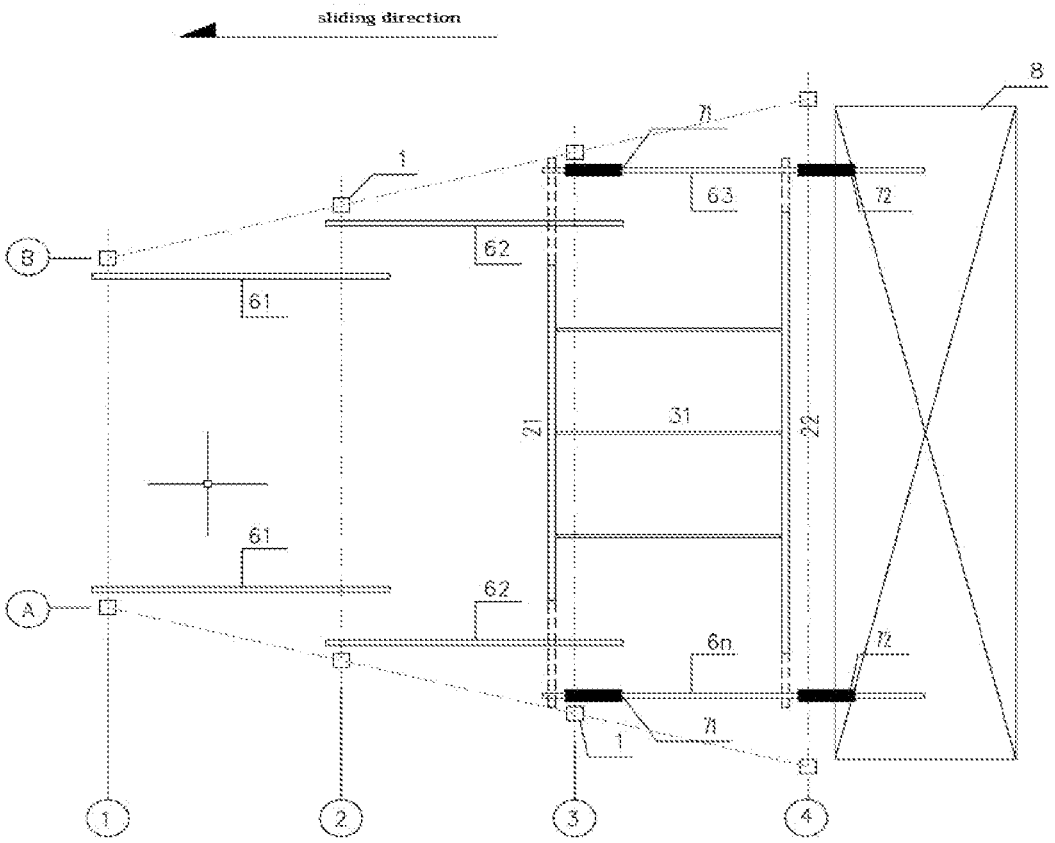
FIG. 5 is a further schematic diagram illustrating a track-changing process according to the first embodiment of the present disclosure.
Figure 6:
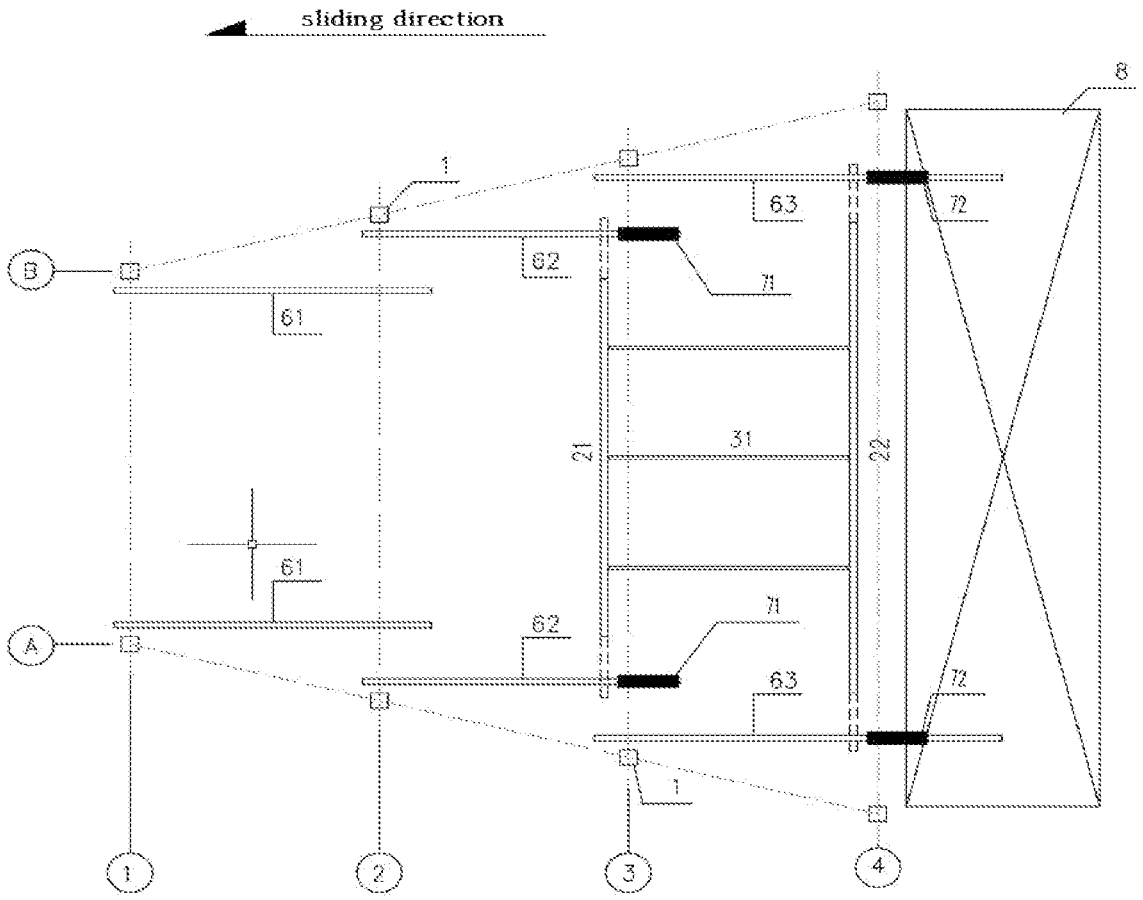
FIG. 6 is a further schematic diagram illustrating the track-changing process according to the first embodiment of the present disclosure.

2. As shown in FIGS. 3-4, the first set of hydraulic thrusters 71 is controlled by a computer control system to push the first main truss and/or beam 21 into an appropriate position, and then the second main truss and/or beam 22 and the corresponding assembled temporary lengthening auxiliary structure 212 are installed on the assembly platform 8. Further, a set of secondary truss and/or beam 31 could be installed to connect the first main truss and/or beam and the second main truss and/or beam to form a stable whole, as shown in FIG. 4. Upon completion of the above installations, the second set of hydraulic thrusters 72 is installed.
3. The two sets of hydraulic thrusters 71, 72 are controlled by the computer control system to push the assembled sliding sections forward until the first main truss and/or beam 21 reaches an overlapping position where the prior (first) track segment meets a subsequent (second) track segment, i.e., the overlapping position of track segments 63 and 62, as shown in FIG. 5.
4. Then the first set of hydraulic thrusters 71 could be removed from the prior track segments 63 and installed at the subsequent track segments 62: and a sub-unit having a length of L2 and corresponding to the track segment 63 is removed from the assembled temporary lengthening auxiliary structure 212. Afterwards, the two sets of hydraulic thrusters 71 and 72 are controlled by the computer control system to push the assembled sliding section forward, and the track-changing process of the first main truss and/or beam 21 is achieved by virtue of the sliders 91 arranged on the first main truss and/or beam 21, as shown in FIG. 6.

As mentioned above, the overlapping length should be long enough to remove the hydraulic thrusters from the prior track segment and to install them on the subsequent track segment. To facilitate the sliding out and removal of sliders from an end of the prior track segment and then the sliding in of the slider at an end of the subsequent track segment, the prior track segment may be provided with a guiding exit at the end that the slider slides out, and the subsequent track segment may be provided with a guiding entrance at the end that the slider slides in, thereby achieving the track-changing process.

Figure 7:
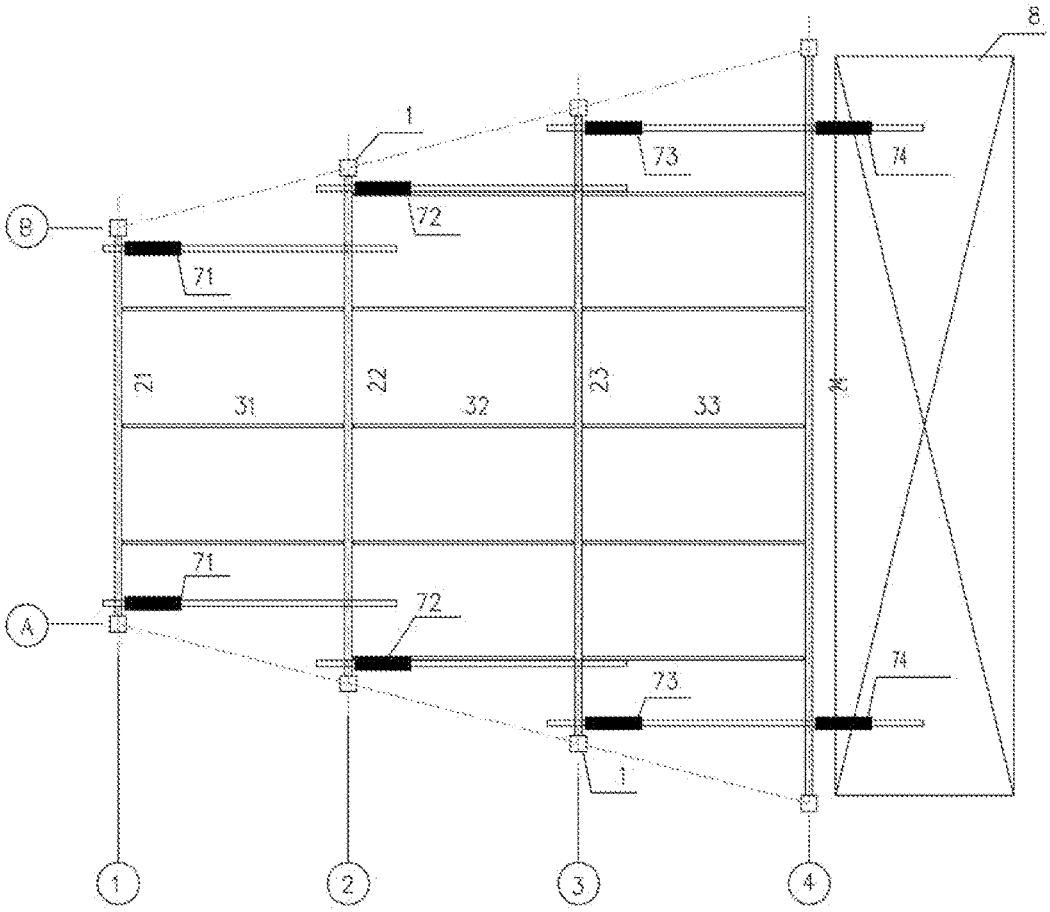
FIG. 7 is an as-built drawing illustrating the process of segmental track-changing and accumulative sliding construction according to the first embodiment of the present disclosure.

(6) Accumulative sliding is implemented. A subsequent main truss and/or beam is assembled on the assembly platform 8, and then a corresponding secondary truss and/or beam is assembled. The subsequent main truss and/or beam is connected to the assembled sliding sections as a whole by the corresponding secondary truss and/or beam therebetween, according to design requirements. Then, another set of hydraulic thrusters could be arranged. With reference to the substeps 3 and 4 of step (5) in this method, the subsequent main trusses and/or beams are sequentially assembled and slid forward in a track-changing process. After the three sliding sections are all slid in position, the remaining main truss and/or beam 24 is installed. Thus the whole structure is installed, as shown in FIG. 7.

In the present embodiment, as shown in FIG. 11, before the first main truss and/or beam 21 is pushed to slide, an assembled anti-overturning temporary auxiliary device 13 is arranged at front and rear of the main truss and/or beam 21 in the sliding direction. The assembled anti-overturning temporary auxiliary device 13 is formed by welding stabilizer rods 131 and columns 132, which may be made from section steel or steel plate. A web plate is provided at an end of the stabilizer rod 131 and is temporarily fixed to the connecting plate 141 or 142 arranged on the lower chord 212 of the main truss and/or beam through bolts. The columns 132 of the assembled anti-overturning temporary auxiliary device 13 are supported on the sliding rail 6*n*, and the distance L from the center line of the columns 132 to the center line of the main truss and/or beam 21 shall be at least half the height H of the cross section of the main truss and/or beam 21. At least one slider 91 is arranged between the columns 132 and the track segments 63 to ensure a smooth sliding, and the sliders 91 may be formed by welding the steel key block or steel plate.

After the first main truss and/or beam 21 and the second main truss and/or beam 22 are connected together as a whole, the assembled anti-overturning temporary auxiliary device 13 arranged on the first main truss and/or beam 21 can be removed.

Figure 12:
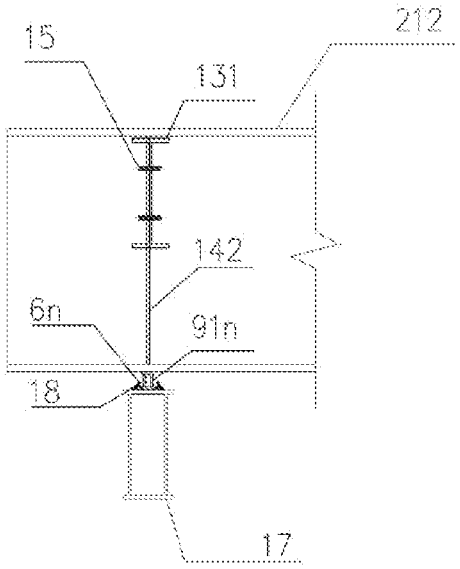
FIG. 12 is a cross sectional view of FIG. 11 along B-B line.

As shown in FIG. 11, one end of each of the hydraulic thrusters 71 is fixed to the connecting plate 142 arranged on the lower chord 212 of the main truss and/or beam by one or more pins, and the other end is connected to a pushing base 12 through one or more pins. The pushing base 12 is formed by welding steel plates, and is supported on side dams 18 at both sides of the sliding track segments during operation of the hydraulic thrusters 71. In the present embodiment, the track segments is preferably made of channel steel, as shown in FIGS. 11 and 12, wherein FIG. 12 is a sectional view of FIG. 11 taken along B-B line. Side dams 18 are welded on both sides of the track segments in a direction along the length of the track, and the spacing of the side dams 18 is matched with the stroke of the hydraulic thrusters.

FIG. 11 shows a detailed view of the support of the first main truss and/or beam during initial sliding, wherein the track segment 63 is fixed to the track beam 17 and at least one slider 91 is provided between the lower chord 212 of the main truss and/or beam and the track segment 63. The track beam 17 is supported on the track beam supporting structure 4, which is fixedly connected with the structural columns 1.

Figure 13:
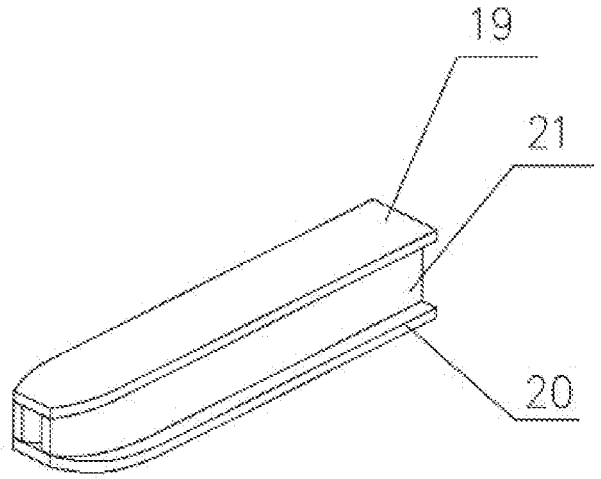
FIG. 13 is a detail drawing of the structure of a slider according to the present disclosure.
Figure 14:
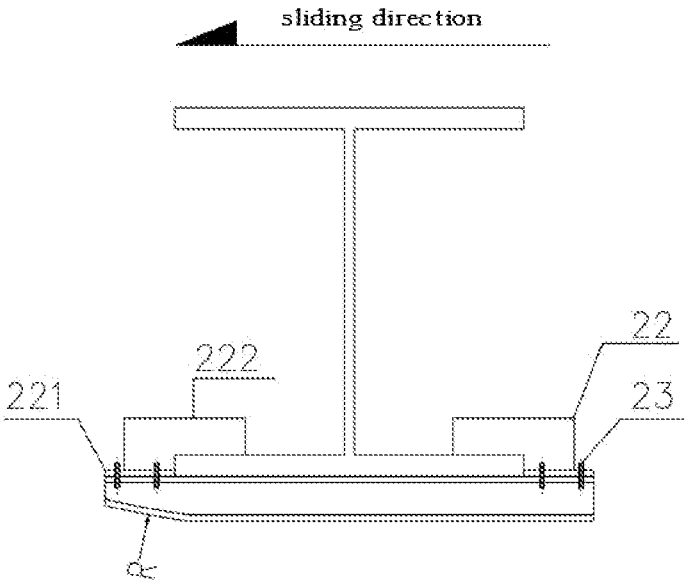
FIG. 14 is a detail drawing of a connection between the slider and the sliding main truss and/or beam according to the present disclosure.

The structure of the slider 91 is shown in detail in FIG. 13, and the slider 91 is formed by welding an upper cover plate 19, a lower cover plate 20 and a web plate 21, wherein the lower cover plate 20 is shaped as a sledge by bending upwards with a radius R in the sliding direction. The slider 91 is connected to the lower chord of the sliding structure by connecting elements 22, which are formed by welding at least one end plate 221 and an L-shaped clamping plate 222. The end plate 221 is connected with the upper cover plate 19 of the slider 91 through bolts 23, and the clamping plate 222 is clamped with the lower flange of the lower chord of the sliding structure, as shown in FIG. 14.

1. Embodiment 2

Embodiment 2 of the present application is shown in FIGS. 15-23.

When the roof or floor in an unequal-span structure in the first embodiment shown in the FIG. 1 is constructed by sliding from the small-span side to the large-span side of the structure, the method comprises the following steps.

Figure 15:
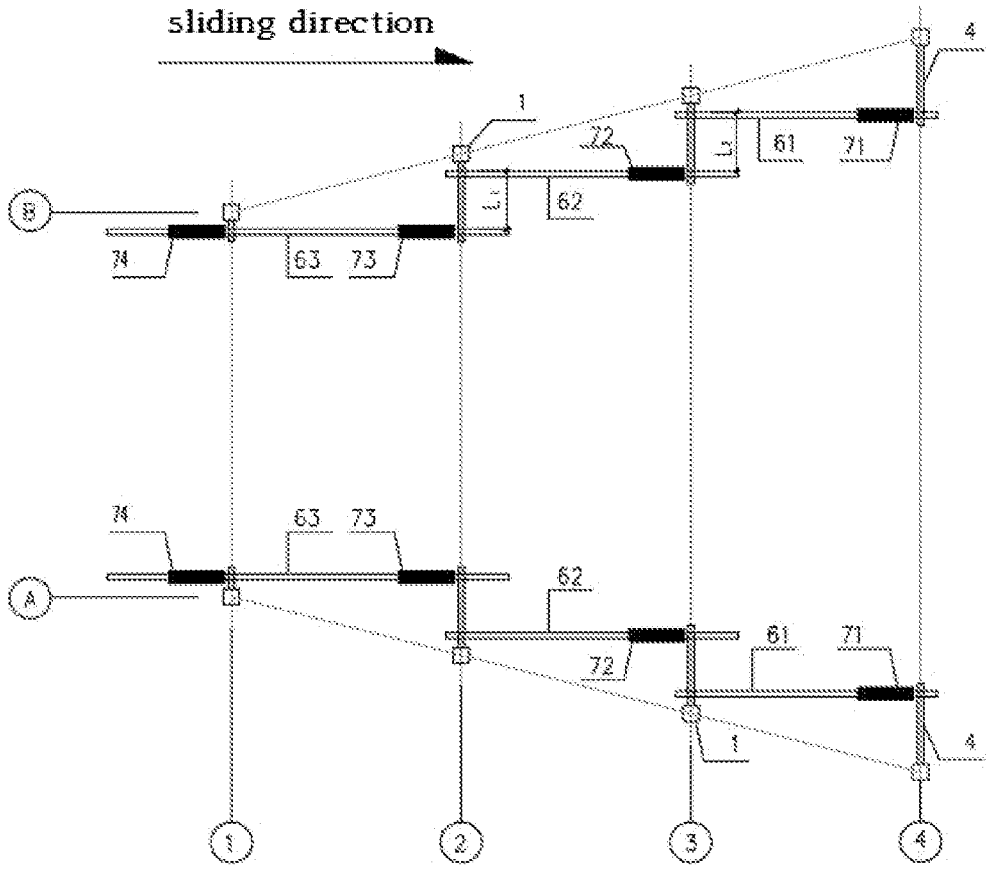
FIG. 15 is a schematic diagram showing the layout of a sliding track and an equipment system according to the second embodiment of the present disclosure.

(1) The sliding track is designed and arranged. As shown in FIG. 15, the design of the sliding track is the same as that in the first embodiment, but the track segments and the sliders 91 in this embodiment are numbered in reverse order, since the sliding direction is reversed.

The track segments, the track beam, the track beam support structure, the sliders 91, and the connections between the sliders 91 and the sliding main trusses and/or beams are arranged in the same way as those in the first embodiment, as shown in FIGS. 11-14.

(2) The whole process of accumulative sliding, the weight of the sliding structure and the track layout are analyzed, so that the specification, quantity and layout of the sliding hydraulic thrusters 71, 72, 73 and 74 are determined, as shown in FIG. 15.

Figure 16:
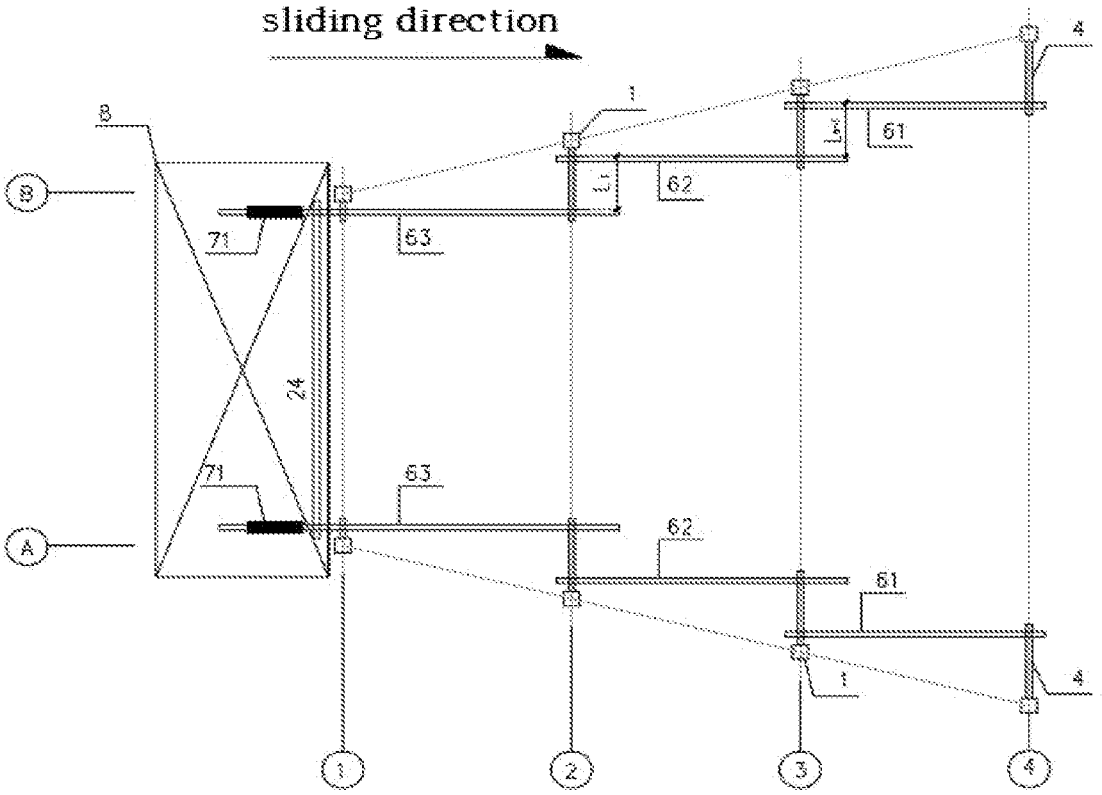
FIG. 16 is a schematic diagram of a main truss and/or beam prepared for assembly according to the second embodiment of the present disclosure.

(3) The track segments and assembly platform are installed. As shown in FIG. 16, the track beam 17, the track beam supporting structure 4 and the track segments 61, 62 and 63 are installed according to the design of step (1), and an assembly platform 8 used to assemble the sliding structure section by section is mounted to the sliding track at the initial sliding end where the track segment has a smaller track gauge. Once a sliding section is assembled, the sliding section could be slide on the track segments, such that each sliding section could be assembled and slid from the assembly platform to the other end of the sliding track.

(4) The sliding process begins.

Figure 21:
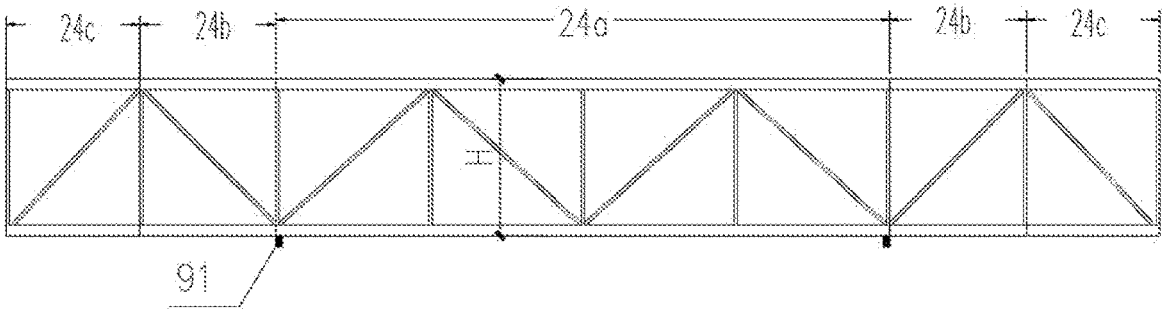
FIG. 21 is a schematic diagram illustrating division of an initial sliding unit and its rear-mounted units according to the second embodiment of the present disclosure.

1. Initial sliding is prepared. The first main truss and/or beam 24 is divided into an initial sliding unit 24*a* and rear-mounted units. The span of the initial sliding unit 24*a* matches the track gauge of the initial track segments 63. Each of the rear-mounted unit is divided into a plurality of sub-units, and the length of each sub-unit is determined by the track gauge differences of two adjacent track segments. As shown in FIG. 21, the length of the rear-mounted sub-units is L1 and L2, respectively. The initial sliding unit 24*a* and corresponding sliders 91 are assembled on the assembly platform 8, as shown in FIG. 16.
2. The assembled anti-overturning temporary auxiliary device 13 and the first set of hydraulic thrusters 71 are arranged at front and rear of the initial sliding unit 24*a* in its sliding direction, as shown in FIG. 11 in the first embodiment. After the above preparation work, the first set of hydraulic thrusters 71 is controlled by the computer control system to push the initial sliding unit 24*a* of the first main truss and/or beam 24 to slide.

Figure 17:
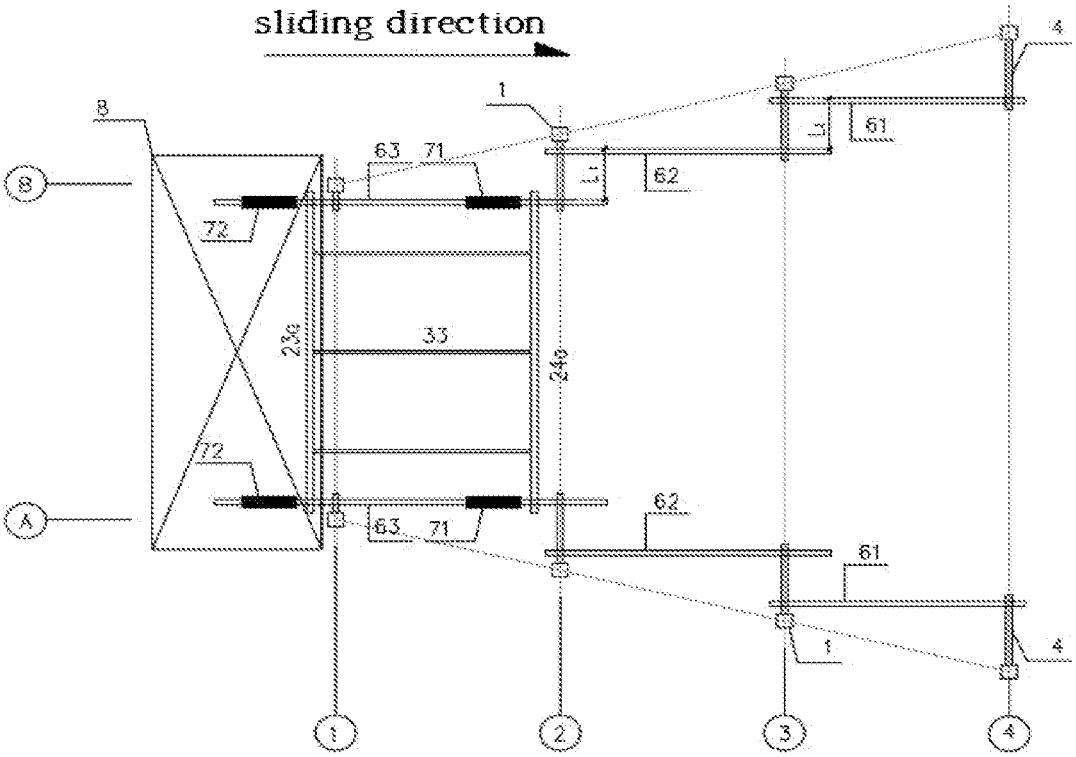
FIG. 17 is a schematic diagram illustrating the track-changing process according to the second embodiment of the present disclosure.

(5) The track-changing process is performed. The sliding process of each main truss and/or beam is analyzed and the track segments on which each main truss and/or beam successively slides are determined. Then the sliders 91 could be arranged at corresponding positions of the initial sliding unit 24*a* and the rear-mounted units, so that the track-changing process can be achieved between the track segments with different track gauges. Taking the first sliding main truss and/or beam 24 as an example, this step is carried out as follows:

1. The first main truss and/or beam 24, which is of the largest span length, needs to slide on all three track segments 63, 62 and 61 in sequence. As shown in FIG. 16, the span of the first main truss and/or beam 24 is larger than the track gauges of the track segments 63 and 62, therefore the first main truss and/or beam 24 is divided into the initial sliding unit 24*a* and the rear-mounted units, as shown in FIG. 21, according to the substep 1 of step (4), to enable the first main truss and/or beam 24 to slide on the track segments 63 and 62.
2. The initial sliding unit 24*a*, corresponding sliders 91 and the first set of hydraulic thrusters 71 are assembled on the assembly platform 8, as shown in FIG. 16. The first set of hydraulic thrusters 71 is controlled by the computer control system to push the initial sliding unit 24*a* of the first main truss and/or beam to move to an appropriate position, allowing the initial sliding unit 23*a* of the second main truss and/or beam and corresponding sliders 91 to be assembled and installed on the assembly platform 8. Then one or more secondary trusses and/or beams 33 are assembled between the first main truss and/or beam and the second main truss and/or beam so as to connect the first main truss and/or beam to the second main truss and/or beam as a stable whole, as shown in FIG. 17. Upon completion of the above installations, the second set of hydraulic thrusters 72 could be installed and the assembled anti-overturning temporary auxiliary device 13 could be removed from the first initial sliding unit 24*a*.

Figure 18:
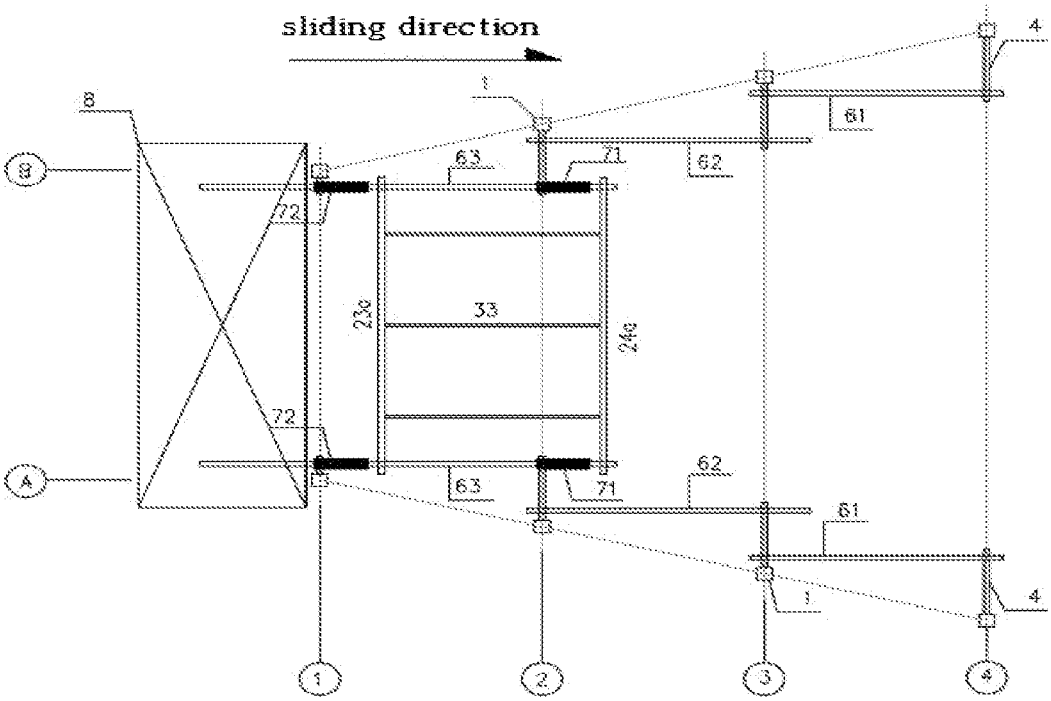
FIG. 18 is a further schematic diagram illustrating the track-changing process according to the second embodiment of the present disclosure.
Figure 19:
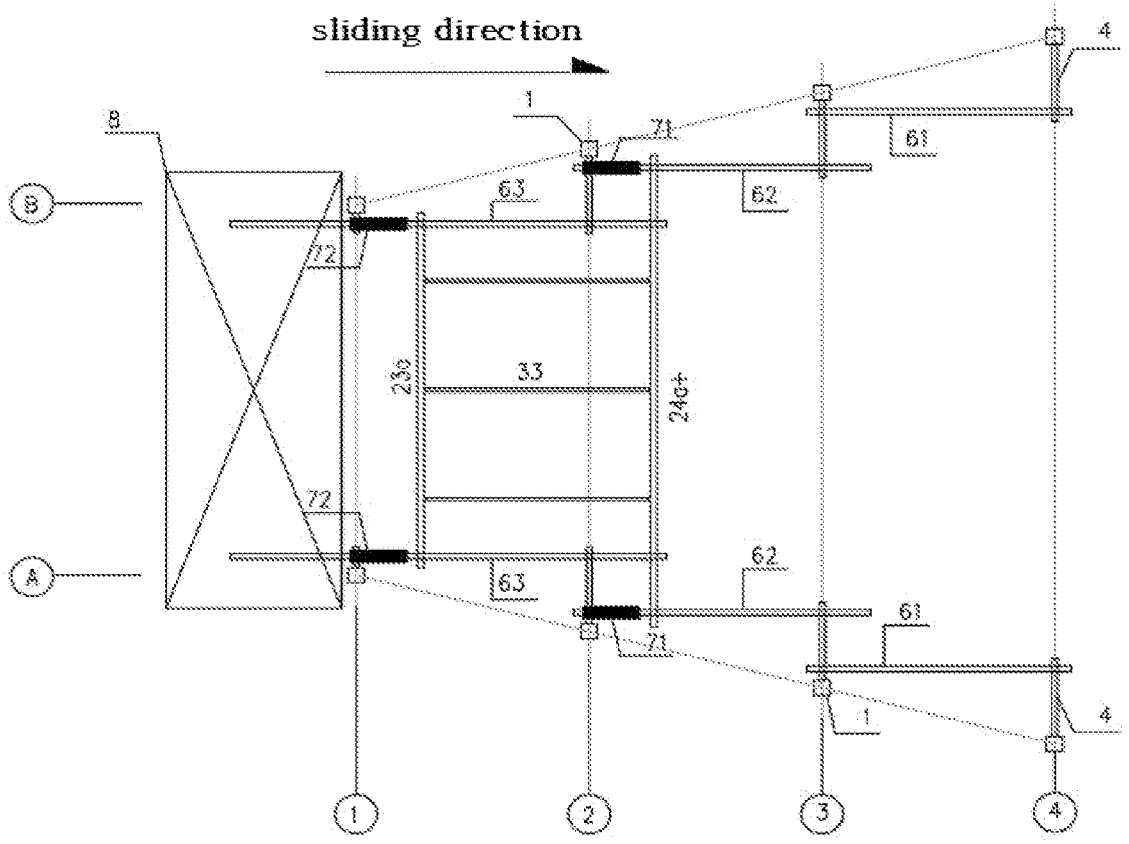
FIG. 19 is a further schematic diagram illustrating the track-changing process according to the second embodiment of the present disclosure.

3. The two sets of hydraulic thrusters 71 and 72 are controlled by the computer control system to push the first sliding section containing the initial sliding unit 24*a* forward until the initial sliding unit 24*a* reaches the overlapping position where the prior (first) track segment meets a subsequent (second) track segment, i.e., the overlapping position of track segments 63 and 62, as shown in FIG. 18.
4. Rear-mounted units 24*b* with a length of L1, which is corresponding to the track gauge difference between the track segments 62 and the track segments 63, are assembled at both ends of the initial sliding unit 24*a*. The first set of hydraulic thrusters 71 is removed from the prior track segments 63 and installed at the subsequent track segments 62, as shown in FIG. 19. Then the two sets of hydraulic thrusters 71 and 72 could be controlled by the computer control system to push the sliding section forward further, so that the track-changing process is achieved. The rear-mounted units may be installed in a high-altitude spread operation method.

Figure 22:
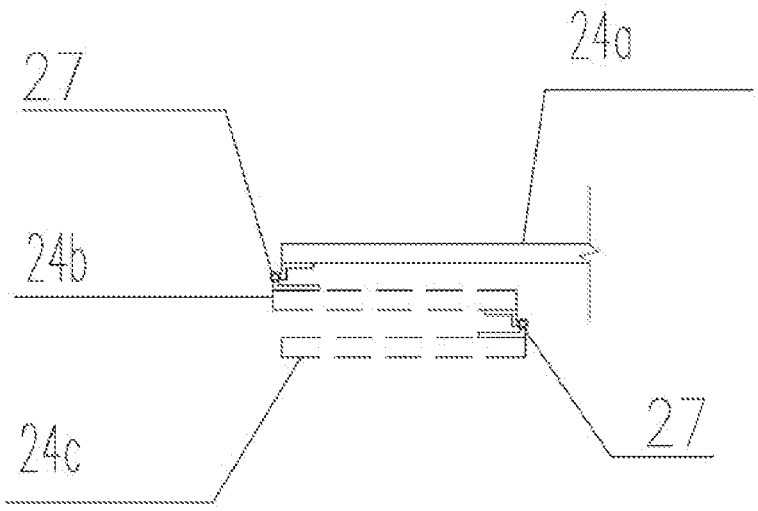
FIG. 22 is a schematic diagram illustrating the folding connection of the initial sliding unit and the rear-mounted units according to the second embodiment of the present disclosure.
Figure 23:
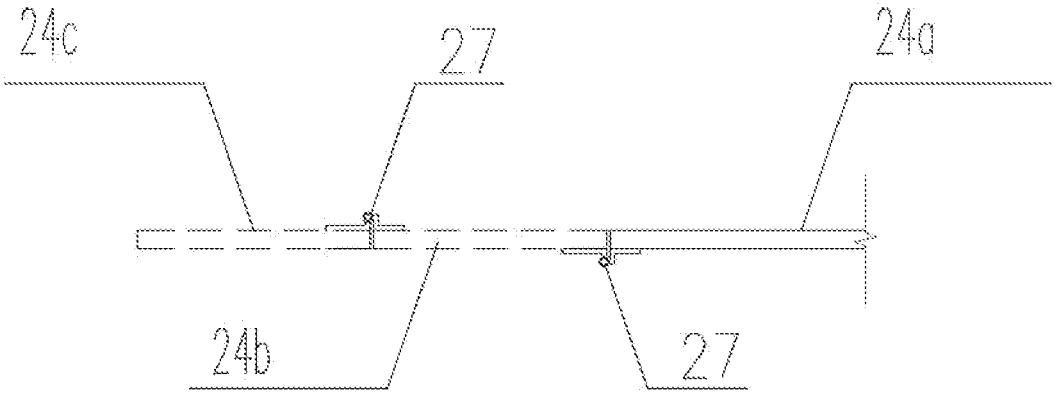
FIG. 23 is a schematic diagram illustrating an unfolded state of the initial sliding unit and the rear-mounted units according to the second embodiment of the present disclosure.

Preferably, to facilitate the construction, the sub-units 24*b* and 24*c* of the rear-mounted unit may be pre-connected to the initial sliding unit 24*a* by dedicated hinges 27. When sliding on a track segments with smaller track gauges, the subunits could be folded to avoid from obstruction, as shown in FIG. 22. When sliding on the subsequent track segments with a larger track gauge, the sub-units 24*b*. 24*c* could be successively unfolded and connected to the main truss and/or beam by means of the dedicated hinge 27, as shown in FIG. 23.

The overlapping length should be long enough to remove the hydraulic thrusters from the prior track segments and to install them on the subsequent track segment. To facilitate the sliding out and removal of sliders from an end of the prior track segment and then the sliding in of the slider at an end of the subsequent track segment, the prior track segment may be provided with a guiding exit at the end that the slider slides out, and the subsequent track segment may be provided with a guiding entrance at the end that the slider slides in, thereby achieving the track-changing process.

Figure 20:
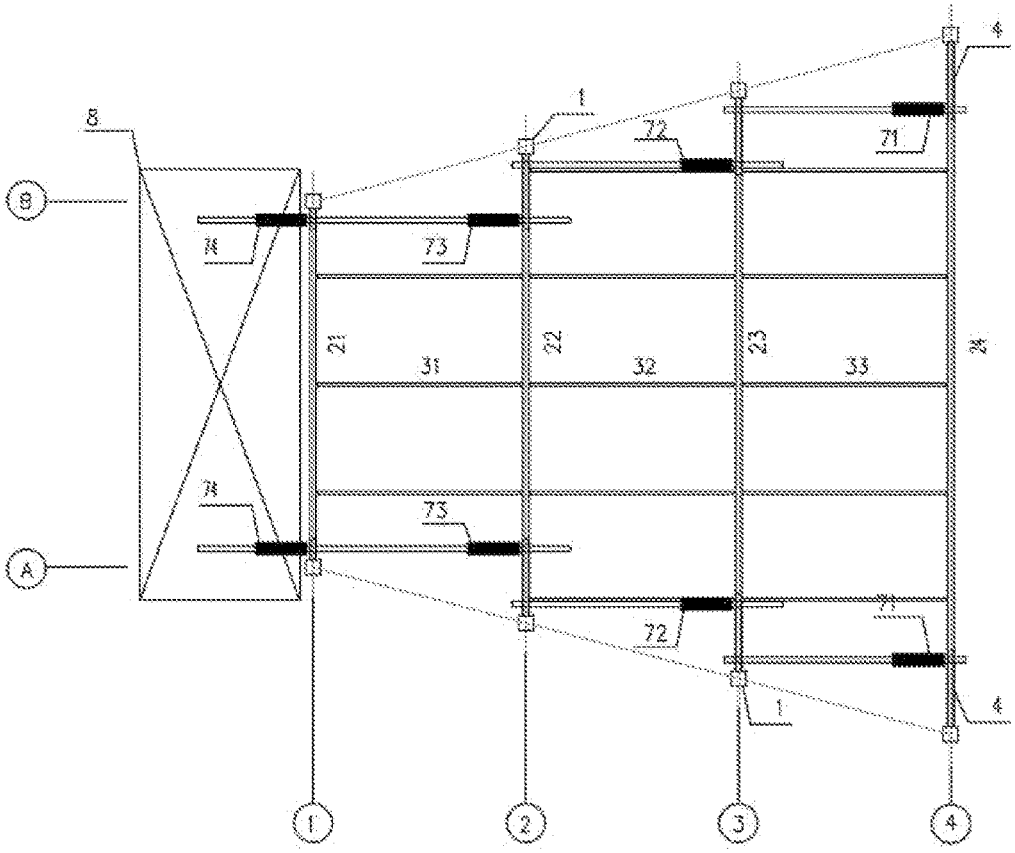
FIG. 20 is an as-built drawing illustrating the process of segmental track-changing and accumulative sliding construction according to the second embodiment of the present disclosure.

(6) Accumulative sliding is implemented. A subsequent sliding main truss and/or beam is assembled on the assembly platform 8 and then a corresponding secondary truss and/or beam is assembled. The subsequent main truss and/or beam is connected to the assembled sliding sections as a whole by the corresponding secondary truss and/or beam therebetween, according to design requirements. Then, another set of hydraulic thrusters could be arranged. With reference to the Sub-steps 3 and 4 of step (5) in this method, the subsequent main trusses and/or beams could be sequentially assembled and slid forward in a track-changing process until the whole structure is installed in position, as shown in FIG. 20.

The above embodiments describe the sliding construction for unequal-span structure comprising four main trusses and/or beams with different spans and three sets of secondary trusses and/or beams. In actual construction, the method can be applied to sliding construction for unequal-span structure including a plurality of main trusses and/or beams with different spans. For example, if an unequal-span structure includes "n" main trusses and/or beams with different spans, "n−1" track segments and "n" sets of hydraulic thrusters could be applied accordingly in this method for sliding construction.

What is claimed is:

1. A segmental track-changing and accumulative sliding construction method for an unequal-span structure, the unequal-span structure includes at least three main structural supports selected from the group consisting of trusses and beams with different spans, wherein the construction method comprises the following steps:

Step 1, designing a sliding track; dividing the unequal-span structure into at least two sliding sections and an individual said structural support according to structural span variation, wherein each sliding section comprises a sliding main said structural support and a sliding secondary said structural support connected to the sliding main structural support;

the sliding track is designed as a plurality of track segments in parallel, wherein both the track segments and the sliding sections have same quantities; each track segment is offset from an adjacent track segment by a certain distance, and the certain distance is respectively corresponding to a span differential between every two adjacent main said structural supports;

Step 2, analyzing a sliding process of the unequal-span structure, a weight of the sliding structure and a track layout, such that a specification, a quantity and a layout of sliding hydraulic thrusters are determined;

Step 3, installing the track segments and an assembly platform; the track segments are arranged according to the design of step 1, and the assembly platform used to assemble the structure is mounted to a first said track segment where the sliding process begins, wherein the first track segment extends onto the assembly platform;

Step 4, starting the sliding process; a first main said structural support is assembled on the assembly platform, and an assembled anti-overturning temporary auxiliary device is also arranged for preventing the first main structural support from overturning during the sliding process, and then the first main structural support is pushed away from the assembly platform along the sliding track by the hydraulic thrusters;

after the first main structural support leaving the assembly platform, a second main said structural support is assembled on the assembly platform, and a secondary main said structural support is assembled between the first main structural support and the second main structural support so as to connect the first main structural support to the second main structural support together as a whole, then the assembled anti-overturning temporary auxiliary device is detached, thus a first said sliding section is completely assembled;

Step 5, sliding in a track-changing process; pushing the first sliding section in Step 4 and the second main structural support forward by the hydraulic thrusters until the first main structural support reaches an overlapping position where the first track segment meets a second said track segment;

each main structural support is provided with a slider corresponding to the second track segment that a respective said main structural support slides on, so that the respective main structural support leaves the first track segment and slides on the second track segment by virtue of the slider to achieve the track-changing process;

after the respective main structural support at the overlapping position slides onto the second track segment by virtue of the slider corresponding to the second track segment, the slider is removed for installation to subsequent said main structural supports;

Step 6, implementing an accumulative sliding process; assembling a respective said subsequent main structural support on the assembly platform and assembling corresponding secondary main said structural supports, connecting the respective subsequent main structural support to the assembled prior main structural support together as a whole by the corresponding secondary main structural support therebetween to form a respective assembled sliding section, arranging another set of hydraulic thrusters to push the respective assembled sliding section to move forward; repeating the step 5 until a whole the unequal-span structure is completely installed.

2. The method of claim 1, wherein, when a respective span of the respective main structural support is smaller than a track gauge of a respective said track segment on which the respective main structural support slide, both ends of the respective main structural support are attached with assembled temporary lengthening auxiliary structures.

3. The method of claim 2, wherein the assembled temporary lengthening auxiliary structure includes a plurality of sub-units, a length of each sub-unit is determined by a track gauge difference of two adjacent track segments of the plurality of track segments.

4. The method of claim 3, wherein, as the sliding main structural support passes one of the track segments, the sub-units corresponding to the one of the track segments are removed.

5. The method of claim 1, wherein, when a respective span of the respective main structural support is larger than a respective track gauge of the track segment on which the respective main structural support slide, the respective main structural support is divided into an initial sliding unit and rear-mounted units that are installed at both ends of the initial sliding unit, wherein a span of the initial sliding unit is equal to the respective track gauge.

6. The method of claim 5, wherein connections between the respective main structural support and assembled temporary lengthening auxiliary structures, connections between the initial sliding unit and the rear-mounted units, connections between plurality of sub-units of the assembled temporary lengthening auxiliary structures, and connections between plurality of sub-units of the rear-mounted units are formed by channel steels and high strength bolts.

7. The method of claim 5, wherein each of the rear-mounted units comprise a plurality of sub-units, and a length of each sub-unit corresponds to a track gauge difference of two adjacent track segments of the plurality of track segments.

8. The method of claim 7, wherein as the sliding main structural support passes one of the track segments, the sub-units corresponding to next one of the track segments are mounted.

9. The method of claim 7, wherein folding hinges are used for mounting the rear-mounted units to the initial sliding unit, as well as connections between the plurality of sub-units of the rear-mounted units, and as the sliding main structural support passes one of the track segments, one of the plurality of sub-units corresponding to the next one of the track segments is unfolded.

* * * * *